US005301477A

United States Patent [19]

Rellinger et al.

[11] Patent Number: 5,301,477

[45] Date of Patent: Apr. 12, 1994

[54] PANEL SYSTEM

[75] Inventors: Michael Rellinger, Chicago; Richard R. Gilbert, Barrington; Sara E. Green, Chicago, all of Ill.

[73] Assignee: Quartet Manufacturing Company, Skokie, Ill.

[21] Appl. No.: 888,051

[22] Filed: May 22, 1992

[51] Int. Cl.[5] ..... A47B 5/00

[52] U.S. Cl. ..... 52/36.1; 52/36.2; 52/239; 248/220.2

[58] Field of Search ..... 52/36.2, 36.4, 36.6, 52/36.1, 239; 434/162, 365, 408, 430; 248/220.2, 225.1, 221.2, 307; 40/617

[56] References Cited

U.S. PATENT DOCUMENTS

| | | | |
|---|---|---|---|
| 4,607,753 | 8/1986 | Radek | 52 X/36.5 |
| 4,731,960 | 3/1988 | Sease | 52/36.6 |
| 4,809,479 | 3/1989 | Tierno | 52 X/36.5 |
| 4,845,904 | 7/1989 | Menchetti | 52/36.6 |
| 4,944,416 | 7/1990 | Petersen | 52/36.5 |
| 4,961,295 | 10/1990 | Kosch | 52/36.5 |
| 5,018,323 | 5/1991 | Clausen | 52/36.4 |
| 5,063,715 | 11/1991 | Goodman | 52/36.6 |
| 5,137,239 | 8/1992 | Horton | 248/221.2 |
| 5,165,640 | 11/1992 | Williams | 248/221.2 |

*Primary Examiner*—Carl D. Friedman
*Assistant Examiner*—Beth A. Aubrey
*Attorney, Agent, or Firm*—Martin Faier

[57] ABSTRACT

A panel system for office workstations wherein a display board is removably secured to a hanging bar, The bar has a bracket assembly for selectively and removably hanging it onto a selected surface and has flanges arranged in the bar which may receive the bracket assembly and which removably secure the display board on the hanging bar when the display board is oriented with the flanges in a predetermined position. The display board has a frame defined by top, bottom and side extrusions and corner members joining the extrusions together, utilizing channels arranged in the extrusions, and hangers slideably fixed in the extrusion channels which are adapted to be secured in channels when properly oriented therewith. A tray may also be removably secured in the channels of the display board extrusions in selected removably secured positions.

31 Claims, 4 Drawing Sheets

FIG. 6
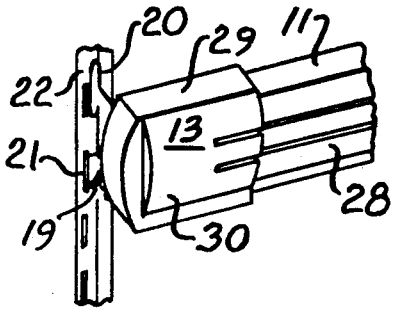
FIG. 7
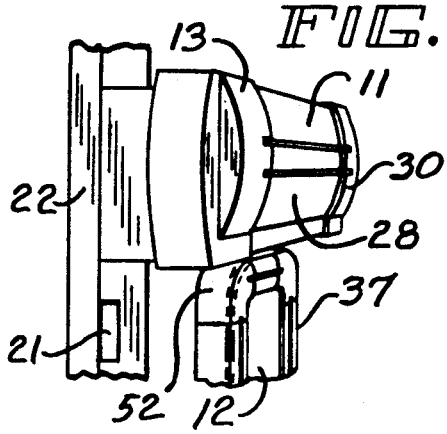
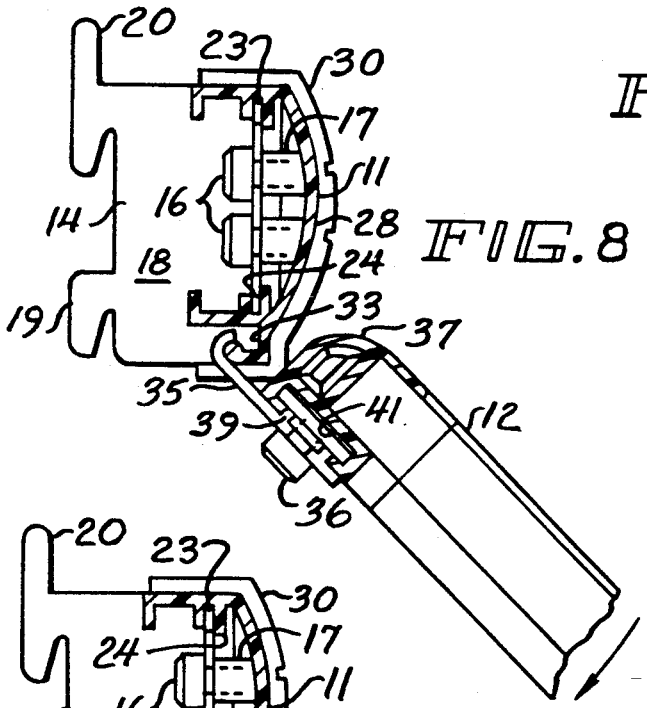
FIG. 8
FIG. 10
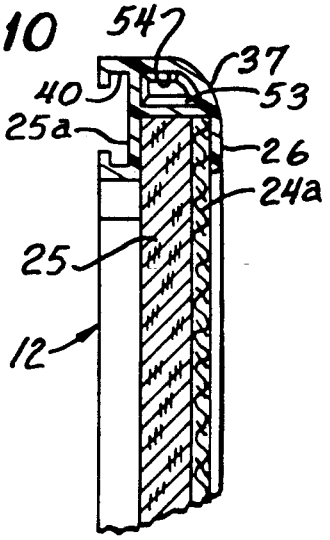
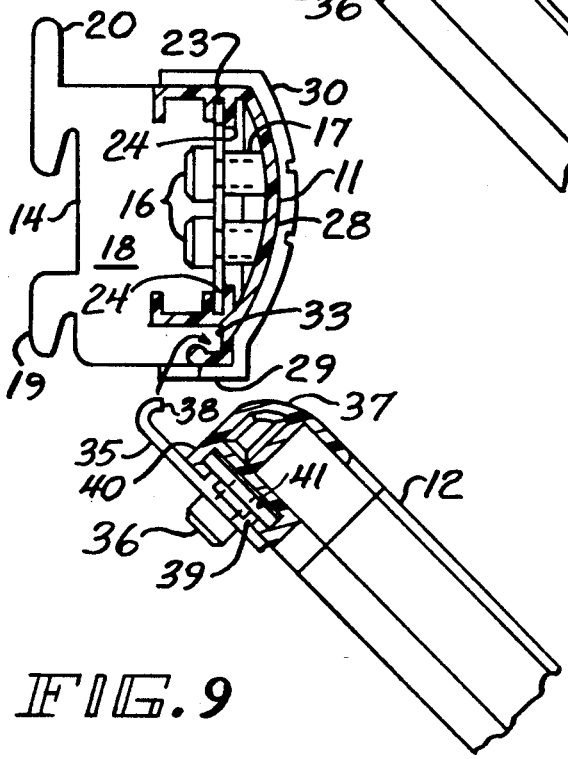
FIG. 9
FIG. 11
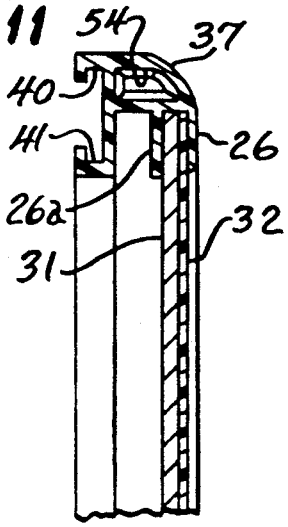

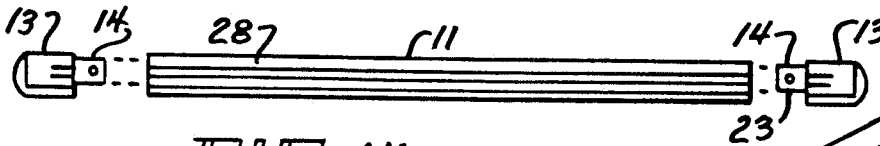
FIG. 14
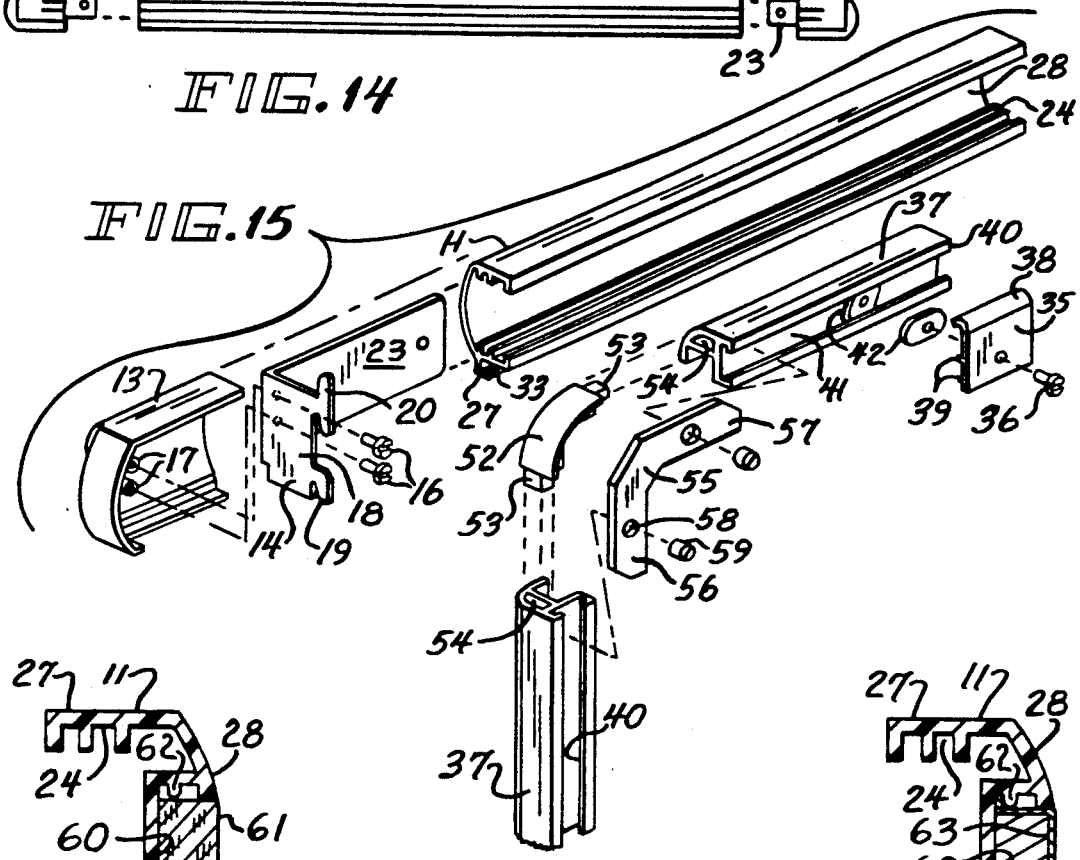
FIG. 15
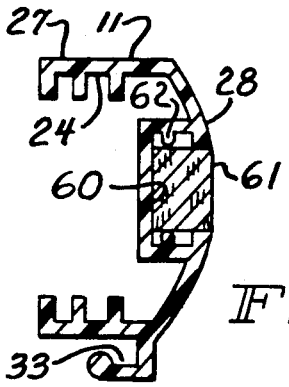
FIG. 16
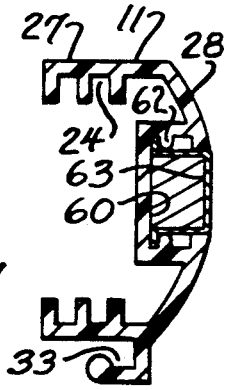
FIG. 17
FIG. 18
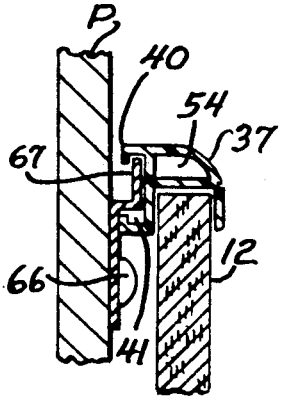
FIG. 19
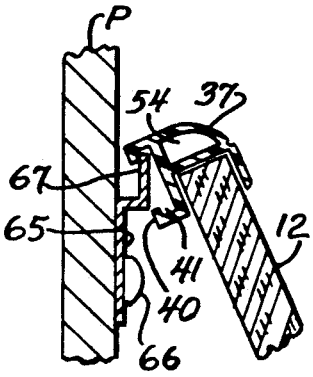
FIG. 20
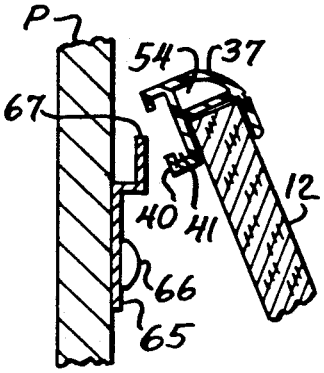

PANEL SYSTEM

This invention relates to a panel system and is more particularly directed to a system of display boards, such as writing and bulletin boards, which may be easily used in a modern office environment, such as with modular workstation partitions. Through the use of the panel system embodying the present invention, small office spaces may be organized and achieve greater a flexibility, and the "jungle" of lost or misplaced memos may be reduced or avoided.

BACKGROUND AND SUMMARY OF THE INVENTION

The panel system embodying the present invention essentially consists of two members, i.e. (1) a display board, such as a writing board, which may comprises a dry erase surface, like melamine, or a bulletin board, which may be a fabric covered surface capable of receiving push pins, or both, and (2) a hanging bar on which multiple or single boards of either or both a writing board and a bulletin board may be removably secured.

Preferably, this hanging bar is sufficiently versatile to be mounted on modular workstation panels or slotted uprights of various standard widths and depths and may be mounted at any height within defined dimensions, as selected by the user. For most installations, only slight variations in the brackets for mounting the bar on a surface need to be made to accommodate the mounting position selected by the user.

Such a bar may also be used for mounting on any wall surface, even one without standard slots, with the use of special brackets, as disclosed herein. The hanging bar embodying the present invention in designed to easily accommodate various kinds of mounting hardware in a stable and effective fashion, with only limited variations in the mounting brackets being necessary to meet the mounting conditions desired.

Such a hanging bar, in association with the hanging hardware on the board, also provides easy means for removably secured mounting of selected boards. Even while providing easy changeover of boards, the hanging bar also provided stable mounting of the boards, in a way that unintended jolting of the board or other related structure will not cause the board to be dislodged unintentionally from the hanging bar. Further, the bar is capable of receiving horizontally arranged insert strips, which may be used for mounting materials suitable for receiving push pins or magnets, or decorative strips to vary the appearance of the hanging bar.

With reference to the display boards, they are constructed to be easily oriented in a selected horizontal or vertical direction, and the orientation may be easily changed. The invention also includes a tray for holding markers, pointers, push pins or similar items; and this tray may be secured to the bottom of the board and easily moved at right angles when the board is reoriented, and the tray has effective means for looking and unlocking it in a selected position. Boards of various colors, textures and configurations are completely interchangeable, without rearranging the hanging bar in any way. In most situations, the hanging bar may be mounted and the boards may be varied in the manner discussed without the use of special tools or training. Slight variations from manufacturer to manufacturer or from one office installation to another installation may be easily made by more manipulation of the parts, without having to substantially rearrange the components responsive to these variations.

OBJECTS AND ADVANTAGES OF THE INVENTION

It is the object of the present invention to provide the novel is panel system of the character referred to.

Another object is to provide an inventive hanger bar for a panel system.

Another object is to provide unique display boards for a panel system.

Another object is to provide a hanger bar and display board having cooperating means for selectively and changably securely and slideably mounting the board on the hanging bar.

Another object is to provide a novel tray assembly which may be removably secured on a display board.

Another object is to provide a versatile panel system for a modular workstation which is suitable for removably and adjustably arranging writing or bulletin boards on a hanger bar.

Another object is to provide a panel system which is easy to assemble and rearrange without special tools or knowledge, and which is very efficient in use.

Another object is to provide a panel system of the character referred to which can be expediently and efficiently manufactured at reasonable cost.

These and other objects and advantages of the invention will become apparent as this description proceeds, taken in conjunction with the accompanying drawings.

BRIEF DESCRIPTION OF THE DRAWINGS

In the drawings:

FIG. 6 is a detail perspective view of part of the hanger bar during its mounting on a slotted standard.

FIG. 7 is a detail perspective view showing the board secured on the hanger bar.

FIG. 8 is a sectional view of the hanger bar showing a fragmentary view of the board being mounted thereon.

FIG. 9 is a sectional view similar to FIG. 8, except shoving a fragmentary view of the board removed, but aligned is for securement on the bar.

FIG. 10 is a fragmentary sectional view of a bulletin board adapted to receive push pins therein, embodying the is present invention.

FIG. 11 is a fragmentary sectional view similar to FIG. 10, except showing a modification of a writing board adapted for a user to mark its surface.

FIG. 14 is a plan view of the hanging bar and the removable ends thereof, isometrically arranged.

FIG. 15 is an isometric exploded fragmentary view of the rear of the hanging bar and its associated components and a corner of the board frame with its related parts.

FIG. 16 is a sectional view of the hanging bar having a cork insert therein.

FIG. 17 is a sectional view of the hanging bar like FIG. 16, except with a metal strip inserted into the face of the hanging bar.

FIG. 18 is a fragmental sectional view of another is embodiment of the invention, showing the board secured to a bracket mounted on a conventional wall.

FIG. 19 is a fragmentary sectional view like FIG. 18, is except showing the board during removal from the bracket.

FIG. 20 is a fragmentary sectional view like FIGS. 18 and 19, except showing the board removed from but aligned with the bracket.

DESCRIPTION OF PREFERRED EMBODIMENTS

Figure 2:
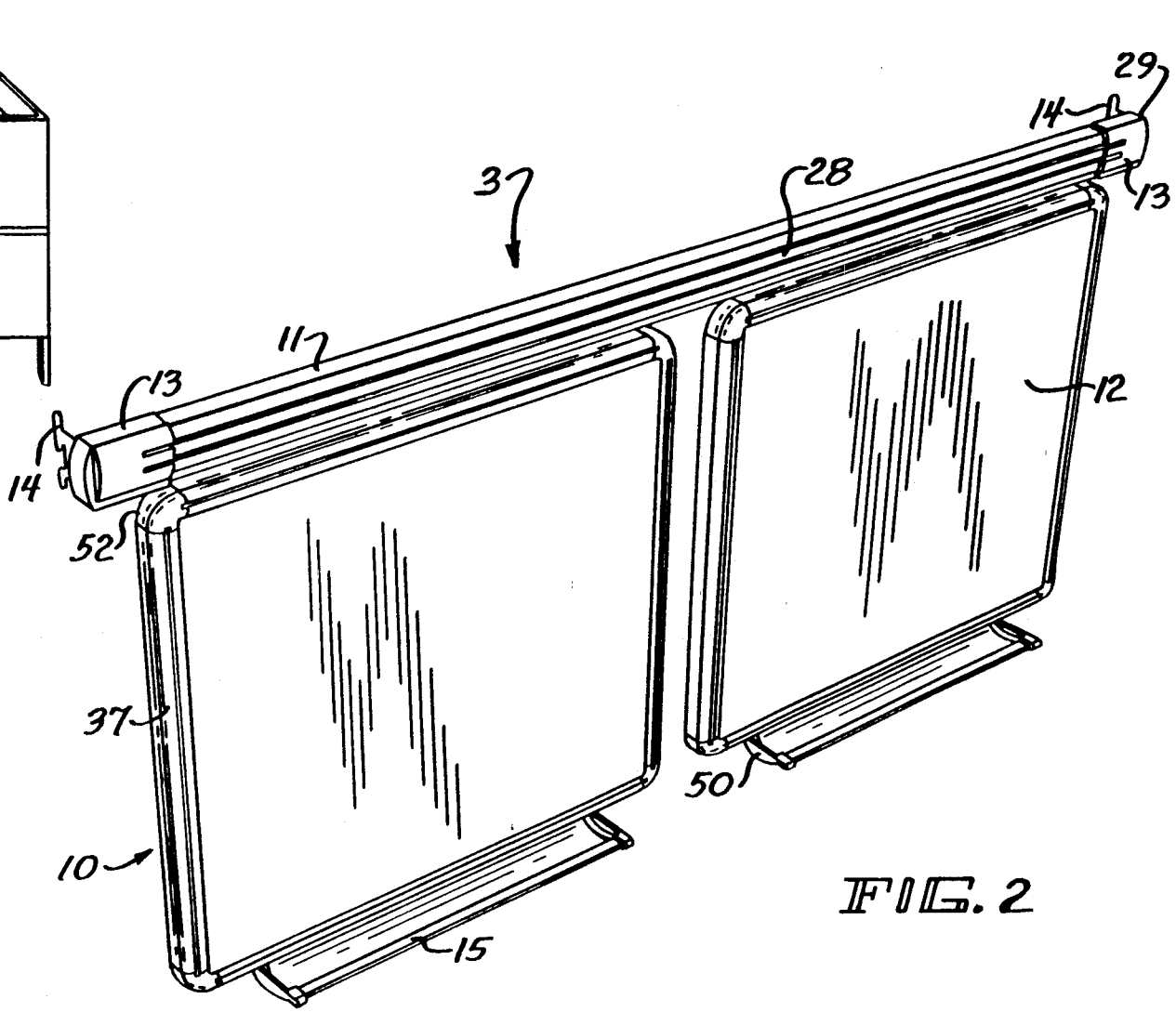
FIG. 2 is a perspective view of a unit embodying the present invention, showing the face of two display boards secured on a hanging bar.
Figure 1:
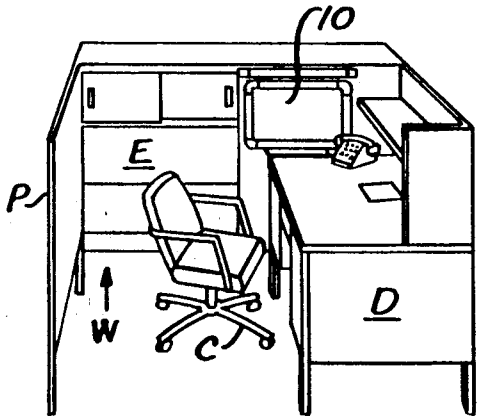
FIG. 1 is a perspective view of a typical office workstation with a panel system embodying the present invention mounted over the desk shown.

The panel system 10 embodying the present invention may be mounted in a conventional office workstation W, which may include a conventional desk D and chair C, filing cabinets P and partitions P.

This panel system 10 comprises a hanging bar 11 and one or more display boards 12. The hanging bar 11 has end caps 13 from which protrude bayonet hangers 14. A tray 15 for holding markers, pointers or similar items may be hung from the lower surface of the board 12.

These bayonet hangers 14 may be mounted by means of screws 16 and spacers 17 in each of the and caps 13, and are preferably "L" shaped; each hanger has on a log 18 of the "L" protruding from each end cap 13 a depending tab 19 and an extension tab 20 which are suitable for entry into the spaced apart slots 21 of a vertical upright 22, such uprights frequently being found in standard workstation modules. The other leg 23 of the "L" is slideably engage in a channel 24 formed in the hanging bar 11, and permits each end cap 13 to be slide about the length of the leg 23 to adjust for alight variances in the spacing between uprights, which may vary from maker to maker and installation to installation.

Preferably the hanging bar 11 has flat parallel top and bottom walls 27 and has a side wall 28 which is generally concave-convex and each end cap is similarly shaped, with flat parallel top and bottom walls 29 and an arc shaped side wall 30 to define a track like arrangement for mounting the end caps 13 on the hanging bar 11. The right end cap and the left end cap 13 are mirror images of one another and engage over and cover each end of the hanging bar 11, respectively.

This hanging bar 11 also has a lower slot 33 running its entire length for removable securement of the board 12 on the hanging bar 11, in a manner to be discussed. As shown in FIGS. 7–9, the display board 12 is secured to the hanging bar 11 in the manner shown in FIG. 7, accomplished by the hook bracket 35 which is preferably mounted by a screw 36 into the extrusion 37, which comprises a frame for the board 12. This hook bracket 35 has a hooked end 38 which can enter the rounded groove 33 in the hanging bar 11, which is shaped to receive the hooked and 38, so that the board 12 cannot be installed on or removed from the hanging bar 11 is except when the board is aligned with the hanging bar at about the position shown in FIG. 8, preferably in the area of about a 25 degree angle to the wall on which the bar 11 and board 12 is mounted.

When in position, the board 12 hangs straight from the hanging bar 11, as shown in FIGS. 3–5 and 7. This hook bracket 35 has a pair of spaced apart horizontally aligned ridges 39 which bear against flanges 40 on the channel 41 formed in the extrusion 37 of the board 12, when its oval shaped mounting nuts 42 are drawn up in the channel, upon threading of screw 43 through hook bracket 35 as shown in FIG. 15.

Since all the extrusions 37 are identical, the board 12 may be oriented vertically or horizontally, depending upon which flange 40 and channel 41 is selected, and its orientation may be easily changed by merely loosening oval nuts 42 and screw 43 and moving the hook bracket 35 to a selected position. Also, as hereinafter described, the tray 15 may also be re-oriented as desired, in a manner as hereinafter described.

Figure 5:
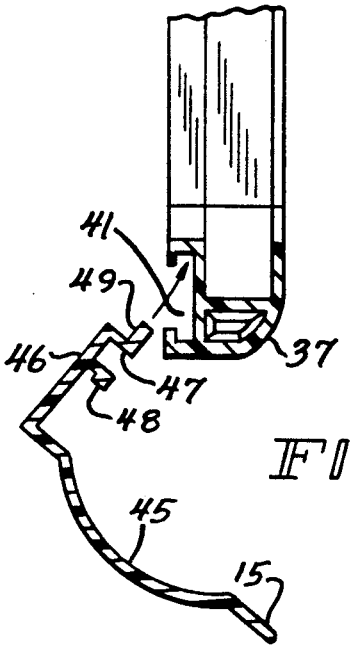
FIG. 5 is a sectional view similar to FIGS. 3 and 4, except showing the board tray removed, but aligned for insertion.
Figure 3:
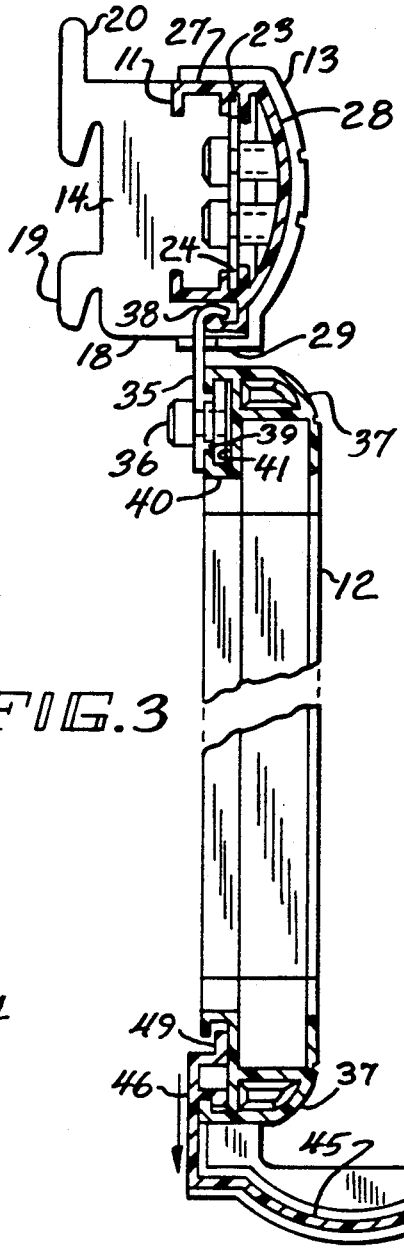
FIG. 3 is sectional view, with parts of the board broken away, showing the panel system, taken on line 3—3 of FIG. 2.
Figure 4:
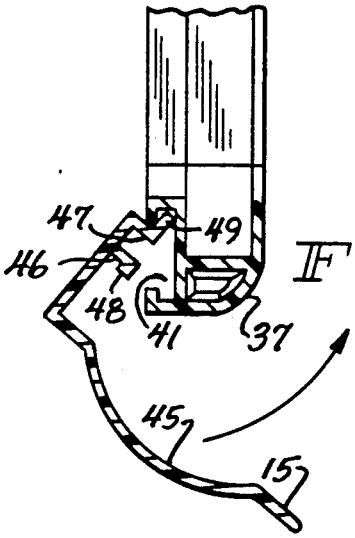
FIG. 4 is a sectional view similar to FIG. 3, except showing the board tray during removal.
Figure 12:
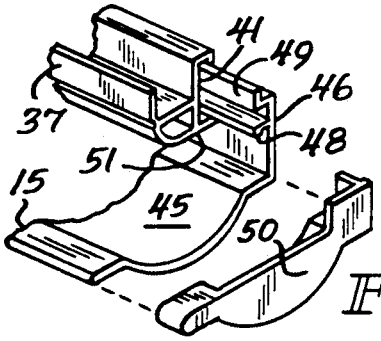
FIG. 12 is a fragmentary perspective view showing the securement of the tray and its end caps, from the face side of the board.
Figure 13:
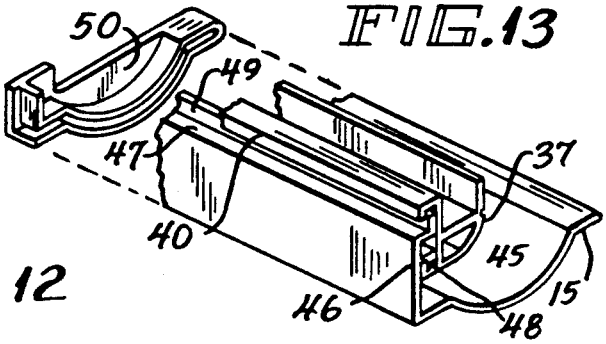
FIG. 13 is another fragmentary perspective view of the tray and end cap arrangement, from the rear side of the board.

As shown in FIGS. 3–5, this channel 41 is also used for securing a tray 15 to the bottom of the board 12. This tray 15 comprises a well 45 for holding markers and the like, and upstanding therefrom a pair of spaced apart flanges 46 and 47 dimensioned for entry into the channel 41 of the extrusion 37. One flange 46 has a depending lip 48 and the other flange 47 has an upstanding rib 49 to seat within the channel flanges 40 securing the tray from downward movement. Once the tray 15 is installed in the selected position as shown in FIG. 3, locking member 50, one for each longitudinal edge of the tray 15, which are contoured and adapted to fit over the well 45 of the tray 15, may be installed. These tray locking members 50 wedge against the flat side 51 of the extrusion 37 to secure the tray 15 in position and prevent it from sliding from side to side.

With reference to FIG. 10, the board may comprise a body 25 of wood, cork or similar material capable of receiving and holding push pins or thumb tacks, preferably overlaid with a face of loose woven fabric **24*a*, which may be secured to the body, as by gluing, and hold in position between flanges 25*a* and 26 of the extrusion 37. Alternatively, as shown in FIG. 11, the board may comprise a rigid panel 31 which has a writing surf ace 32, like melamine, laminated thereon, and this panel may be secured in position between the face flange 26 and an intermediate flange 26*a* formed on the extrusion 37**.

Each of the extrusions 37 comprising the sides of the board frame are joined together by means of rounded corners 52, each of which has a nose 53 extending therefrom which fits into a groove is 54 in the extrusion 37. These extrusions 37 and corners 52 are also secured together by means of corner keys or brackets 55, one for each corner 52 of the board 12. Each bracket 55 has one leg 56 which first into the channel 40 of a related extrusion 37 comprising the top or bottom of the frame, and a second log 57 which fits into the channel 40 of another related extrusion 37 comprising one of the side walls of the frame, each said leg 56 and 57 having a threaded aperture 58 therethrough for securing a set screw 59 to its related channel 40, as shown in FIG. 15.

As shown in FIG. 16, the side wall 28 of the hanging bar 11 may alternatively be formed with a recess 60, into which a strip 61 of cork or similar material may be press-f it and held by fingers 62. Alternatively, as shown in FIG. 17, a hollow strip 63, which may be made of stool or other rigid material may be press-fit into the recess 60 and hold in position by fingers 62. The cork strip 61 may be used to mount a display f rom the header or hanger bar 11, or the rigid strip 63 may be used decoratively or to reinforce the hanger bar or to secure magnets over papers displayed on the hanger bar.

In the embodiments shown in FIGS. 18–20, the display board 12 may be mounted with a modified bar comprised of a wall bracket 65. Such a wall bracket 65 may be secured to a wall by a nail 66 or similar fastener. The wall bracket 65 has an offset portion 67 is suitable for receiving thereover the extrusion channel 41 and hold in position by its flanges 40.

While preferred embodiments of the inventions have been shown and described in considerable detail, it should be understood that it is not intended that the invention be limited to the exact structure disclosed, as many parts and sub-assemblies may be modified or changed without departing from the spirit or scope of the invention. Accordingly the invention should not be limited, except according to the appended claims.

We claim:

1. A panel system for a workstation comprising a display board and a hanging bar, said hanging bar having means to removably secure said bar to a wall and a slot member arranged in said bar for receiving and removing said display board from said hanging bar when said display board is disposed angularly to said slot member, and for securing said display board hanging from said bar, said display board having hook means adapted to hang in said slot member when said display board is oriented hanging relative to said hanging bar, said display board having extrusion members defining a frame for said board, said extrusion members being arranged angularly to one another, each of said extrusion members being adapted to removably received and secure said hook means in a selected position for hanging and securing said display in said hanging bar.

2. In the panel system recited in claim 1, wherein said hanging bar securing means has a plurality of hangers, one arranged on each end of said hanging bar.

3. In the panel system recited in claim 2, wherein said hangers have bayonet tab members arranged on an end each hanger spaced apart from said slot member.

4. In the panel system recited in claim 3, wherein said workstation has uprights and spaced apart vertically arranged slots on said uprights, and said bayonet tab members are adapted to enter and lock into said upright slots.

5. In the panel system recited in claim 1, wherein said hanging bar has end caps, one arranged on each end of said hanging bar, and each of said end caps carry said means for removably securing said bar to said wall.

6. In the panel system recited in claim 5, wherein each one of said end caps is slidable in said bar toward and away from the other of said end caps.

7. In the panel system recited in claim 6, wherein each said end cap has an "L" shaped bracket, one leg of which carries said wall securing means and the other leg of which is slidable in said hanging bar.

8. In the panel system recited in claim 5, wherein each said end cap is telescopically arranged over and covers the related end of said hanger bar.

9. In the panel system recited in claim 1, wherein said hanger bar has a recess along a length of said bar on a face of said bar remote from said wall securing means and said recess is adapted to contain a strip of material arranged therein.

10. In the panel system recited in claim 9, wherein said strip of material comprises a body of porous material adapted to removably secure push pins therein.

11. In the panel system recited in claim 9, wherein said strip of material comprises a body of metallic material adapted for securement in said recess.

12. In the panel system recited in claim 11, wherein said metallic material is magnetic and adapted to removably secure magnet means thereon.

13. In the panel system recited in claim 1, wherein said extrusion members are joined together by corner assemblies, one arranged at the end of each extrusion member.

14. In the panel system recited in claim 13, wherein each of said extrusion members has a channel longitudinally arranged from end to end.

15. In the panel system recited in claim 14, wherein each of said corner assemblies has a corner bracket secured in the channels of said extrusion members.

16. In the panel system recited in claim 15, wherein said hook means is adapted for removable securement in said extrusion channels.

17. In the panel system recited in claim 13, wherein each of said corner assemblies comprises a substantially "L" shaped member, and each said "L" shaped member has a nose on the free end of each leg of said "L" shaped member which extends into a related extrusion member.

18. In the panel system recited in claim 1, wherein said hook means is adapted for removable securement in a channel arranged longitudinally in each of said extrusion members.

19. In the panel system recited in claim 18, wherein said display board has a display surface and a hanging surface, and said channel opens toward said hanging surface.

20. In the panel system recited in claim 19, wherein said channel has upstanding flanges.

21. In the panel system recited in claim 20, wherein said hook means comprises a hook bracket consisting of a hooked end and an is end adapted for securement in said channel, said securement end comprising rib means adapted to engage said upstanding flanges.

22. In the panel system recited in claim 20, wherein said hook means has fastener means adapted for removable securement in said extrusion channel against said upstanding flanges.

23. In the panel system recited in claim 1, wherein a side of said display board opposite from said hanging bar carries a removably secured tray.

24. In the panel system recited in claim 23, wherein said tray has flange members adapted for removable securement in another extrusion member arranged parallel to and spaced apart from said extrusion member securing said hook means therein.

25. In the panel system recited in claim 24, wherein said extrusion member securing said tray has a flanged channel for receiving said tray flange members.

26. In the panel system recited in claim 24, wherein locking members for opposed ends of said tray each engage over said tray and are wedged against said related extrusion member.

27. In the panel system recited in claim 1, wherein said display board comprises a frame arranged around and securing therein a display surface, said frame comprising a plurality of said angularly arranged extrusion members, each of said extrusion members having flanges extending toward one another for holding said display surface therein, said display surface being arranged on a side of said display board remote from said hook means.

28. In the panel system recited in claim 27, wherein said display surface comprises a body of material adapted to removably receive push pins therein and fabric overlying an exposed surface of said body.

29. In the panel system recited in claim 27, wherein said display surface comprises a body of rigid material and an exposed surface thereon adapted for receiving indicia.

30. A panel system for a workstation comprising a display board and a hanging bar, said hanging bar comprising a bracket having a surface adapted for mounting on a wall and a surface offset from said wall mounting surface, said display board comprising a frame arranged around and securing therein a display surface, said frame comprising a plurality of angularly arranged extrusion member, each of said extrusion members having therein a channel, each said channel being adapted to extend over and hang from said bracket offset surface when arranged in hanging engagement on said bracket.

31. In the panel system recited in claim 30, wherein opposed upstanding flanges extend toward one another from said extrusion member channel and said bracket offset surface is adapted for removable securement against said flanges when said board is hung from said hanging bar.

* * * * *